US007404241B2

(12) United States Patent
Murayama et al.

(10) Patent No.: US 7,404,241 B2
(45) Date of Patent: Jul. 29, 2008

(54) SILENT SURFACE FASTENER

(75) Inventors: Teiichi Murayama, Namerikawa (JP); Shintaro Ohsugi, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/363,363

(22) Filed: Feb. 27, 2006

(65) Prior Publication Data

US 2006/0137148 A1 Jun. 29, 2006

Related U.S. Application Data

(63) Continuation of application No. PCT/JP2004/011915, filed on Aug. 19, 2004.

(30) Foreign Application Priority Data

Aug. 29, 2003 (JP) ..... 2003-307205

(51) Int. Cl.
*A44B 21/00* (2006.01)

(52) U.S. Cl. ..... 24/444; 24/442

(58) Field of Classification Search ..... 24/442, 24/444–447, 306, 452
See application file for complete search history.

(56) References Cited

U.S. PATENT DOCUMENTS

| | | | | |
|---|---|---|---|---|
| 3,086,529 | A * | 4/1963 | Munz et al. | 606/203 |
| 3,256,882 | A * | 6/1966 | Huber | 602/60 |
| 4,776,068 | A | 10/1988 | Smirlock et al. | |
| 4,884,323 | A | 12/1989 | Provost et al. | |

FOREIGN PATENT DOCUMENTS

| | | |
|---|---|---|
| JP | 6-103 | 1/1994 |
| JP | 2000-70010 | 3/2000 |

* cited by examiner

*Primary Examiner*—Jack W. Lavinder
(74) *Attorney, Agent, or Firm*—Alston & Bird LLP

(57) ABSTRACT

A silent surface fastener comprises a base part (2), a plurality of engaging elements (3*a*, 3*b*) raised from the base part, and a vibration-damping material layer (10) disposed on the back surface of the base part. According to one preferred embodiment, the vibration-damping material layer is disposed on the back surface of the base part through the medium of a bonding layer. The vibration-damping material layer is desired to have a loss tangent (tanδ) at −40 to 40° C. of 0.05-2.5 and a thickness of 0.3-10 mm. According to the other preferred embodiment, the base part is made from a woven or knitted base fabric, the plurality of engaging elements are made of a monofilament, and the fineness of the monofilament is 100-500 T (deciTex).

4 Claims, 5 Drawing Sheets

SILENT SURFACE FASTENER

CROSS-REFERENCE TO RELATED APPLICATIONS

This is a continuation of Application PCT/JP2004/011915, filed Aug. 19, 2004, which was published under PCT Article 21(2).

BACKGROUND OF THE INVENTION

1. Field of the Invention

This invention relates to a silent surface fastener, more particularly to a surface fastener adapted to produce reduced sound during peeling of the fastener from its mating member, and to a product to which the surface fastener has been attached.

2. Description of the Prior Art

In general, a loud noise is generated during peeling of a surface fastener from its mating member. This peeling noise poses a problem in the use of some objects, such as clothes and bags for military applications. Therefore, the reduction of noise is required.

As to a method for reducing noise during peeling of a surface fastener from its mating member, development has been heretofore directed to the modification of a base part itself of a surface fastener to such structure that will generate noise only with difficulty or that will propagate vibration only with difficulty. For example, U.S. Pat. No. 4,776,068 proposes to decrease the propagation of vibrational energy to the air by making the base part itself of a surface fastener into a lattice-like structure (mesh structure). It further teaches that the vibration will be suppressed by forming a base fabric with a high-mass thread.

Further, U.S. Pat. No. 4,884,323 discloses a method of intervening a mounting member between the base part of a surface fastener and a fabric to which the surface fastener is attached to decrease the contacting area between the fabric and the surface fastener, thereby suppressing the propagation of sound.

On the other hand, JP 2000-70010 A teaches that a plurality of hook-like engaging elements with small diameters will be effective in suppressing the generation of an unusual peeling noise owing to the small diameter while maintaining necessary engagement force.

According to the methods disclosed in above-mentioned U.S. Pat. Nos. 4,776,068 and 4,884,323, the surface fastener itself will produce a small peeling noise before attachment to a fabric. However, a disadvantage is that it will produce greatly increased noise when it is attached to a fabric and opened and closed practically. In the case of the structure where a mounting member has been intervened between the base part of a surface fastener and a fabric, the surface fastener takes a floated state over the fabric, and the operating characteristics of engagement and disengagement are also not ideal. Further, it has another disadvantage that the type of fabrics to which the fastener can be attached is limited because the material to be attached, particularly the material of a high-density texture, tends to easily propagate vibration. On the other hand, according to the method disclosed in JP 2000-70010 A, there is no difference in the sound level before and after attachment to a fabric. However, the sound level itself is not so reduced and therefore the effect is inadequate.

SUMMARY OF THE INVENTION

An object of the present invention is, therefore, to provide a surface fastener which produces a reduced peeling noise in itself before attachment to a fabric and also produces a reduced peeling noise even when it is attached to a fabric or other article and opened and closed practically.

A further object of the present invention is to provide a surface fastener which is not subject to the restriction of the article to which it is attached and which produces a reduced peeling noise even when it is attached to a material of a high-density texture.

To accomplish the objects mentioned above, the present invention provides a surface fastener comprising a base part and a plurality of engaging elements raised from the base part, characterized by further comprising a vibration-damping material layer disposed on the back surface of the base part.

In accordance with a preferred embodiment of the present invention, the vibration-damping material layer is disposed on the back surface of the base part mentioned above through the medium of a bonding layer. The thickness of the vibration-damping material layer mentioned above is desired to be in the range of 0.3 to 10 mm, preferably 0.5 to 5.0 mm.

In accordance with a further preferred embodiment of the present invention, the vibration-damping material layer mentioned above has a loss tangent (tanδ) at −40 to 40° C. in the range of 0.05 to 2.5, preferably 0.5 to 2.5. According to another preferred embodiment, the base part mentioned above is made from a woven or knitted base fabric, the plurality of engaging elements are made of a monofilament, and the fineness of the monofilament is in the range of 100 to 500 T (deciTex), preferably 100 to 250 T.

In accordance with the present invention, there is further provided a surface fastener material comprising a fabric and the surface fastener as mentioned above attached to the fabric.

The above-mentioned loss tangent (tanδ) is generally used as an index of vibration-damping properties and is the ratio of the loss elastic modulus to the storage elastic modulus, which provides a value varying with the type and temperature of material. Vibration-damping material with a larger loss tangent excels in vibration absorption properties. When a material has a value exceeding 1, it is said to be an excellent vibration-damping material.

Since the surface fastener of the present invention is used in wide regions of temperature from the frigid region to the torrid region, it is necessary to specify the loss tangent in the service temperature region. Therefore, it is desirable that the vibration-damping material to be used in the present invention should have the loss tangent in the range of 0.05 to 2.5 at −40 to 40° C. That is, if the vibration-damping material used has the peak of the curve of loss tangent in the region of 0.05 to 2.5 at −40 to 40° C., it can exhibit excellent silent operation as to the peeling noise of the surface fastener. The more this value is large, the more the vibration-damping material to be used can be made thin.

The loss tangent (tanδ) specified by the present invention is the value measured by the use of dynamic visco-elasticity measuring equipment (RSA-II manufactured by LEOMETRIX company) at a drive frequency of 6.28 rad/sec. and in the temperature range of −60° C. to +60° C. However, it is not limited to the conditions mentioned above and any other equivalent test conditions may be adopted. Incidentally, the sample used is a strip test piece having a width of 3 mm and a thickness of 1 mm cut out of a material.

The unit T (deciTex) of "fineness" is represented by gram per filament of 10,000 m and generally used as an index of the diameter which depends on the density of the filament. In the case of a monofilament to be used for an article which requires engagement force (rigidity) like the surface fastener of the present invention, T (deciTex) is generally used rather than the simple diameter (metric system) which is independent of density.

The surface fastener of the present invention reduces peeling noise by absorbing the vibrational energy caused by the separation of two members through the application of the vibration-damping material layer disposed on the back surface of the base part and thus produces minimal propagation of vibration to the article to which the surface fastener is attached. Therefore, the peeling noise can be reduced without being dependent on the article to which the surface fastener is attached. Therefore, it is possible to realize reduced peeling noise even when the surface fastener is attached any article, not only a fabric article but also a PVC product of a synthetic leather, a film composite product, etc.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
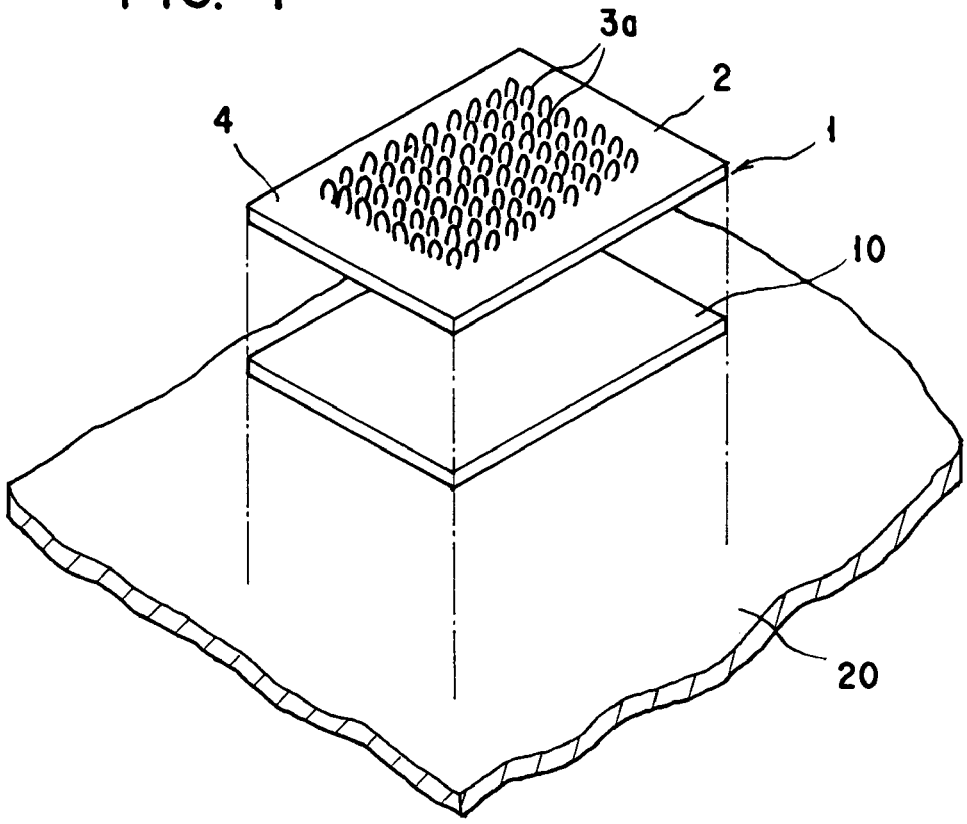
FIG. 1 is an exploded schematic view for assembly illustrating an example of the silent surface fastener according to the present invention.

The sound generated during the separation of two members of a surface fastener is due to the vibration of the hook-like engaging elements of a male surface fastener and the vibration of the loop-like engaging elements of a female surface fastener caused by being stretched and returned to their original states upon separation thereof, the transmittance thereof to a fabric, and emission thereof in the air as vibration sound. In case the surface fastener is attached to an article, such as fabric, the above-mentioned vibration sound propagates to the article attached and is emitted in the air as vibration sound through the medium of the article attached to cause the peeling noise.

As described above, the methods heretofore proposed for reducing the peeling noise are those for making the base part itself of the surface fastener into a structure which will produce sound with difficulty or which will propagate vibration with difficulty. Even when the base part itself is made into such a structure that it will produce sound with difficulty or which will propagate vibration with difficulty, in the event it is attached to an article, such as fabric, the article and the base part will integrally function as a propagation medium of vibration. Therefore, even if the surface fastener itself has the peeling noise reduction effect, when it is once attached to an article, such as fabric, the peeling noise reduction effect of the surface fastener itself will decrease considerably and, as a result, a loud peeling noise will generate.

On the contrary, since the surface fastener of the present invention reduces the peeling noise by absorbing the vibrational energy caused by the separation of two members by means of the vibration-damping material layer disposed on the back surface of the base part (the vibrational energy is consumed as heat due to the internal friction of material), it will scarcely propagate the vibration to an article to be attached. Therefore, the peeling noise is minimized not only as a surface fastener of the single unit before attachment to a fabric, but also when it is actually attached to an article, such as fabric, and opened and closed. That is, the peeling noise can be reduced regardless of the article to which the surface fastener is attached.

Further, the surface fastener of the present invention differs from conventional surface fasteners which aim to attain the noise reduction effect not only in the difference in mechanisms of the above-mentioned peeling noise reduction but also in that it is not influenced by the structure of the base part. That is, in the surface fastener of the present invention the structure of the base part is not limited to the lattice-like structure and the surface fastener can be applied to all the base parts including the woven structure of a general material and differs from the method disclosed in the above-mentioned U.S. Pat. No. 4,776,068 in this point. The present invention is similar to the method disclosed in the above-mentioned U.S. Pat. No. 4,884,323 in that the other substance intervenes between the base part of the surface fastener and a fabric. However, since the contacting area is not changed, the present invention differs from the method disclosed in U.S. Pat. No. 4,884,323. Further, it is not necessary to make the small diameter hook-like engaging elements as the "joined unit" like the surface fastener disclosed in the above-mentioned JP 2000-70010,A. The effect of the structure of the present invention of reducing the peeling noise is clearly large as compared with such a structure.

Incidentally, since the vibrational energy of each engaging element becomes small when the diameter of the engaging element is small, it has the effect of reducing the peeling noise. Therefore, it can be said that it is possible and desirable to use small diameter engaging elements for the surface fastener of the present invention in order to further increase the effect of reducing the peeling noise. When the engaging element is made of a monofilament, the more the diameter of the monofilament is small, the more its effect of reducing the peeling noise is improved. However, the fineness of the monofilament is desired to be in the range of 100 to 500 T (deciTex), preferably 100 to 250 T, to balance noise reduction with strength. Incidentally, also in the surface fastener made of a synthetic resin manufactured by injection molding, a male engaging element is desired to have a thin tip portion in respect to the peeling noise reduction effect, though its diameter is difficult to specify.

As regards the vibration-damping material used in the present invention, any material can be used insofar as it has the loss tangent (tanδ) at −40 to 40° C. of 0.05 or more and it is not limited to a particular material. However, a rubber-like elastic material such as, for example, a natural rubber, styrene-butadiene rubber, acrylonitrile-butadiene rubber, butadiene rubber, isoprene rubber, chloroprene rubber, butyl rubber, nitrile rubber, ethylene-propylene rubber, chlorosulfonated polyethylene rubber, acrylic rubber, silicone rubber, or fluororubber may be advantageously used. For example, the loss tangent of polyurethane rubber is about 0.3-1.3 and the loss tangent of natural rubber is about 0.1-1.0. On the other hand, although the loss tangent of a thermoplastic resin elastomer is generally about 0.05, when its loss tangent can be increased by the addition of a vibration-damping active agent, it may be advantageously used. As a vibration-damping active agent, additives (active ingredients capable of increasing the amount of dipole moments) as disclosed in JP 9-302139 A, for example, may be cited.

As the above-mentioned active ingredients, for example, mercaptobenzothiazyl group-containing compounds such as N,N-dicyclohexylbenzothiazyl-2-sulfenamide, 2-mercaptobenzothiazole (MBT), dibenzothiazyl sulfide (MBTS), N-cyclohexylbenzothiazyl-2-sulfenamide (CBS), N-tert-butylbenzothiazyl-2-sulfenamide (BBS), N-oxydiethylenebenzothiazyl-2-sulfenamide (OBS), and N,N-diisopropylbenzothiazyl-2-sulfenamide (DPBS); benzotriazole group-containing compounds which contain as a matrix nucleus a benzotriazole having an azole group bonded to a benzene ring and a phenyl group bonded to this nucleus such as 2-{2'-hydroxy-3'-(3",4",5",6"-tetrahydrophthalimidemethyl)-5'-methylphenyl}-benzotriazole (2HPMMB), 2-{2'-hydroxy-5'-methylphenyl}-benzotriazole (2HMPB), 2-{2'-hydroxy-3'-t-butyl-5'-methylphenyl}-5-chlorobenzotriazole (2HBMPCB), and 2-{2'-hydroxy-3',5'-di-t-butylphenyl}-5-chlorobenzotriazole (2HDBPCB); or phthalic esters (the group for esterification includes a phenyl group, a cyclohexyl group, a cyclopentyl group, a cycloheptyl group, 4-methylcyclohexyl group, etc.) may be cited.

When vibrational energy is applied to a resin matrix having such an active ingredient incorporated therein, displacement (rotation, phase shift) will occur in the dipole which exists in the inside of the resin matrix and thus the dipole will be put in an unstable state. Accordingly, each dipole tends to return to a stable state. It is considered that the energy is dissipated at this time, thereby attaining the desired vibration-damping effect.

Although a resin ingredient which constitutes a resin matrix is not limited to a particular type, a material which can exhibit good absorption characteristics of vibrational energy at a temperature at the time of use is desirable. As concrete examples thereof, polymer materials such as polyvinyl chloride, polyethylene, polypropylene, ethylene-vinylacetate copolymer, polymethyl methacrylate, polyvinylidene fluoride, polyisoprene, polystyrene, styrene-butadiene-acrylonitrile copolymer, styrene-acrylonitrile copolymer, and the blends thereof, etc. may be cited besides the above-mentioned rubber-like substances.

The vibration-damping material to be used in the present invention may incorporate therein, as occasion demands, a plasticizer, a stabilizer, a lubricant, an antistatic agent, a shock strength improving agent, a processing assistant, an ultraviolet light absorber, an antioxidant, a pressure-sensitive adhesive, a flame-retardant, etc. besides the above-mentioned vibration-damping active agent.

The thickness of the vibration-damping material is desired to be in the range of 0.3 to 10 mm, preferably 0.5 to 5.0 mm. Although the vibration-damping effect becomes higher as the thickness is larger, it is desirable in respect to pliability that the thickness should be not more than 10 mm, preferably not more than 5 mm.

As regards a method of attaching the vibration-damping material onto the back surface of the base part of a surface fastener, when it is in a liquid state, it can be applied thereto as it is. When it is a film, it can be attached to the base part of the surface fastener by fixedly securing to the back surface thereof through the medium of a bonding layer (an adhesive layer or pressure-sensitive adhesive layer) or by the use of a sewing thread. Further, the surface fastener and the vibration-damping material may also be simultaneously attached to an article, such as fabric, by sewing. Although the attachment method is not limited to a particular one, it is desirable that the vibration-damping material should be attached to the base part so as to cover at least the entire surface area of the region for forming the engaging elements in the base part. It is not desirable that a gap be present between the base part of the surface fastener and the vibration-damping material layer, or that the vibration-damping material layer be floating over the base part. Incidentally, it is desirable to form a slot or slit perpendicular to the direction of engagement and disengagement, or dimpled projections, for example, in the back surface of the vibration-damping material layer (fabric side) so as to give pliability to a surface fastener and to perform the engagement and disengagement easily when attached to a fabric. Such a modification is particularly effective when a surface fastener is thick.

Although it is desirable that the above-mentioned vibration-damping material be attached to both of male and female surface fasteners, it is required to be attached to at least the back surface of a male surface fastener because the vibrational energy of a male engaging element is generally larger than the vibrational energy of a female engaging element at the time of separation.

The base part of the silent surface fastener of the present invention also includes a flat plate-like base material made of a synthetic resin material besides the fibrous structure materials, such as a woven and/or knitted fabric, nonwoven fabric, and lace. When the flat plate-like base part is a woven and/or knitted fabric, a plurality of hook pieces as the male engagement elements are formed by interweaving or interknitting monofilaments in the shape of loops simultaneously with the weaving and/or knitting of the flat plate-like base part (base fabric) and then cutting out respective parts of these loops. When the engagement elements are a plurality of piles as the female engagement elements, the piles are formed by interweaving or interknitting multi-filaments in the shape of piles simultaneously with the weaving and/or knitting of the flat plate-like base part (base fabric) and then performing buffing or the like to form the piles of single fibers oriented to multiple directions.

On the other hand, when the flat plate-like base part is a nonwoven fabric, hook pieces are formed by implanting monofilaments in the nonwoven fabric in the shape of loops and then cutting respective parts of these loops. The piles which are female engagement elements are formed by carrying out back coating or a resin treatment while maintaining the form of a plurality of piles formed on the surface of the nonwoven fabric and then heat-setting them. In the case of a flat plate-like base material made of a synthetic resin, a male surface fastener member is manufactured by integrally molding a plurality of hook pieces on one surface of the base material simultaneously with the molding of this base material.

Hereinafter, the present invention will be specifically described with reference to the drawings in which preferred embodiments of the present invention are illustrated.

Figure 2:
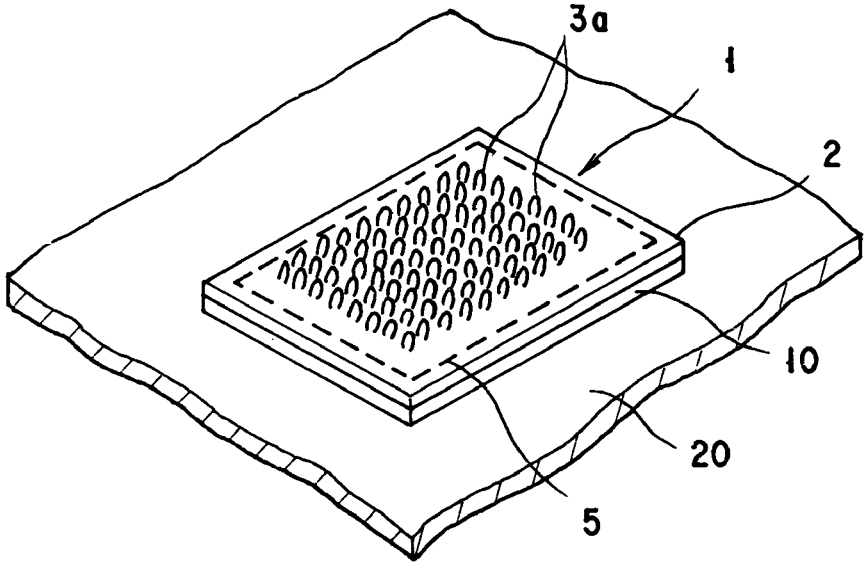
FIG. 2 is a schematic perspective view illustrating the assembled state of the silent surface fastener shown in FIG. 1.

FIG. 1 and FIG. 2 show one embodiment of the silent surface fastener of the present invention and a female surface fastener member having engaging elements 3*a* which are a plurality of piles extending upright from one surface of a flat plate-like base part 2, such as a base fabric, except four marginal space portions 4 is illustrated as the surface fastener 1. However, the present invention is not limited to a female surface fastener member and also applicable to a male surface fastener member having engaging elements formed from hook pieces or mushroom-like male engaging elements and to a surface fastener having male and female engaging elements in a mixed state. Although the structure of the flat plate-like base part of the surface fastener is not specifically shown in the drawings, it is a fibrous structure material, such as a woven and/or knitted product having arbitrary texture or a nonwoven fabric, for example.

In the present invention, a vibration-damping material 10 is attached to the back surface of the above-mentioned surface fastener 1 in which engaging elements 3*a* are not formed. As this vibration-damping material 10, the materials described hereinbefore may be used. Although the attachment of the vibration-damping material 10 to the surface fastener 1 is usually done by fixedly securing the vibration-damping material to the back surface of the surface fastener 1 with an adhesive or a pressure-sensitive adhesive to unify them in advance, it may also be done by sewing them with a sewing thread. Incidentally, when an adhesive or a pressure-sensitive adhesive is used, it is desirable to use a soft material (elastic material) rather than a hard material. Specifically, it is desirable to use an adhesive or a pressure-sensitive adhesive of the rubber type, urethane type, elastomer type or the like for the purpose of reducing peeling noise.

The surface fastener 1 provided on the back surface thereof with the vibration-damping material 10 as described above is attached to an article, such as a fabric 20, through the medium of the vibration-damping material 10, as shown in FIG. 2. In this embodiment, although the description of the concrete structure is omitted, the fabric 20 is also formed from a fibrous structure material, such as a woven and/or knitted product or a nonwoven fabric.

Since the surface fastener 1 and the fabric 20 are unified through the medium of the vibration-damping material 10, when the engaging elements of the surface fasteners in the mutual engagement state are separated, the vibration of the engaging element itself of the surface fastener is not directly transmitted to the fabric. Moreover, since the vibrational energy of the sound generated by the vibration of the engaging element is absorbed by the vibration-damping material, its transmission efficiency decreases remarkably and the sound level to be transmitted into the air damps and becomes low. As a result, the silent surface fastener is realized.

Figure 3:
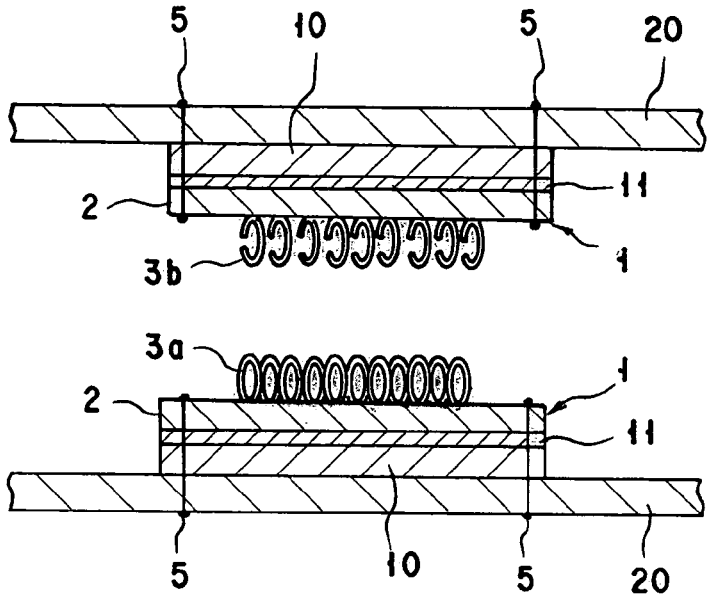
FIG. 3 is a schematic cross-sectional view illustrating an example of the assembled structure of articles to which the male and female silent surface fastener members of the present invention are attached.

FIG. 3 shows an example of the assembled structure when the silent surface fastener of the present invention is attached to an article. As described above, the vibration-damping material 10 is fixedly secured to the back surface of the female surface fastener 1 through the medium of an adhesive layer 11, and thereafter they are sewn onto the fabric 20 with a sewing thread 5. Similarly, the vibration-damping material 10 is also fixedly secured to the back surface of the male surface fastener 1 having a plurality of hook-like engaging elements 3*b* formed thereon through the medium of the adhesive layer 11, and thereafter they are sewn onto the fabric 20 with the sewing thread 5. By pressing the male surface fastener on the female surface fastener, the plurality of hook-like engaging elements 3*b* engages with the plurality of loop-like engaging element 3*a*. When separating them, both the loop-like engaging element 3*a* and the hook-like engaging element 3*b* are stretch and, when disengaged, they vibrate so as to return to their original states, respectively. At this time, the usual surface fastener will produce a peeling noise. In the surface fastener of the present invention, however, since the vibration-damping materials 10 are fixedly secured to both back surfaces of the male and female surface fasteners 1 respectively through the medium of the adhesive layer 11 as mentioned above, the peeling noise becomes remarkably small owing to the function as described above.

Figure 4:
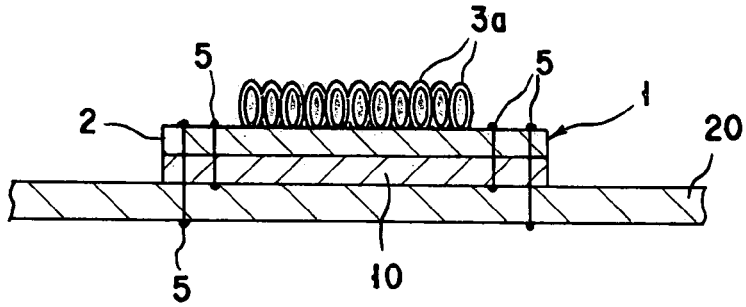
FIG. 4 is a schematic cross-sectional view illustrating another example of the assembled structure of the female silent surface fastener member according to the present invention.
Figure 5:
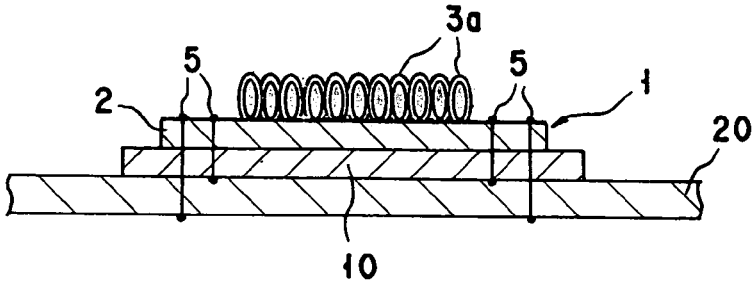
FIG. 5 is a schematic cross-sectional view illustrating a further example of the assembled structure of the female silent surface fastener member according to the present invention.

FIG. 4 and FIG. 5 show other examples of the assembled structure when the silent surface fastener of the present invention is attached to an article. In either case, the surface fastener 1 and the vibration-damping material 10 is firstly unified by sewing them with the sewing thread 5 and then they are unified to the fabric 20 similarly by sewing with the sewing thread 5. However, they differ from each other in the point that the vibration-damping material 10 used in FIG. 5 has the surface area larger than that of the base part 2 of the surface fastener 1, while in FIG. 4 the vibration-damping material 10 has the same surface area as that of the base part 2 of the surface fastener 1. it is desirable that the surface area of the vibration-damping material 10 should be at least the same as that of the base part 2 of the surface fastener 1. By making the surface area of the vibration-damping material 10 larger than that of the base part 2, the propagation of the vibrational energy during the separation can be prevented more effectively and the reduction of the peeling noise can be further improved.

Figure 6:
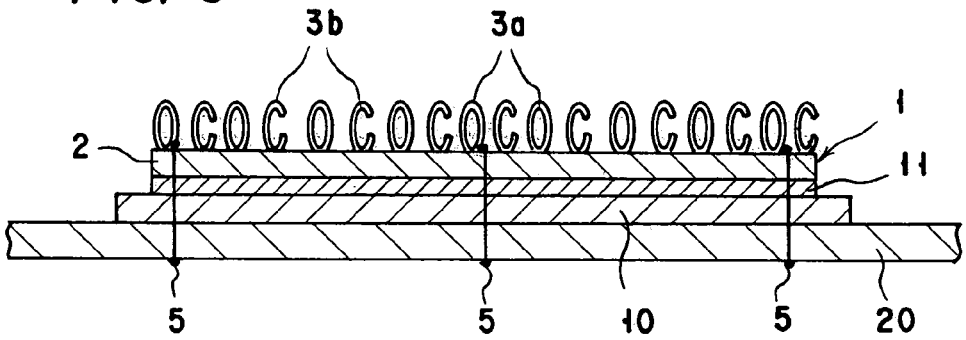
FIG. 6 is a schematic cross-sectional view illustrating an example of the assembled structure of the silent surface fastener member of the male/female mixture type according to the present invention.

FIG. 6 shows an example of the assembled structure when the silent surface fastener formed into a large-sized surface fastener 10 of the male/female mixed type is attached to an article. In this example, the surface fastener 1 used has the engaging elements including the female engaging elements 3*a* and the male engaging elements 3*b* both formed in one surface of the same base part 2 in the mixed state. In such a mixture type surface fastener, the male and female engaging elements are formed by interweaving or interknitting multifilaments and monofilaments both in the shape of loops and in the mixed state simultaneously with the weaving and/or knitting of the flat plate-like base part and then cutting out parts of the loops of monofilaments. Also in this embodiment, the vibration-damping material 10 having a surface area larger than that of the base part 2 is fixedly secured to the back surface of the surface fastener 1 through the medium of the adhesive layer 11, and thereafter they are sewn onto the fabric 20 with the sewing thread 5.

Figure 7:
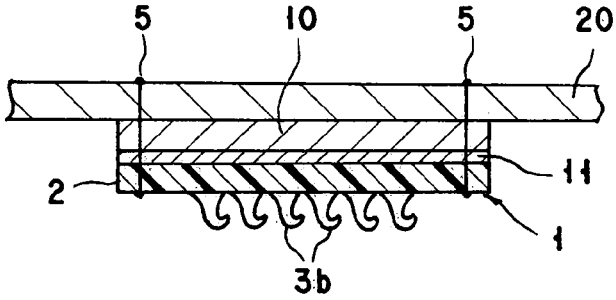
FIG. 7 is a schematic cross-sectional view illustrating an example of the assembled structure of the molded surface fastener made of a synthetic resin according to the present invention.

FIG. 7 shows an example of the assembled structure using the silent surface fastener made of a synthetic resin attached to an article. This surface fastener 1 differs from the embodiments described above in the point that the base part 2 made of a synthetic resin and the male engaging elements 3*b* are integrally formed by injection molding. However, in the same manner as the above-mentioned embodiments, the vibration-damping material 10 is fixedly secured to the back surface of the surface fastener 1 through the medium of the adhesive layer 11, and thereafter they are sewn onto the fabric 20 with the sewing thread 5. Incidentally, when a liquid vibration-damping material is used, the vibration-damping material can be directly applied to the base part of the surface fastener as shown in FIG. 4, for example, and after the vibration-damping material is solidified and unified with the base part, they can be sewn onto the fabric.

Hereinafter, the test examples which have concretely confirmed the effect of the present invention will be described.

<Surface Fasteners Used>

As hook tapes, QUICKRON 1QN (a product made of nylon, monofilament fineness 400 T) and 1QSFN (a product made of nylon, monofilament fineness 190 T) both manufactured by YKK CORPORATION were used. As a loop tape to be combined therewith, QUICKRON 2QM (a product made of nylon, napped type) manufactured by YKK CORPORATION was used Measurement of Peeling Noise:

<Preparation of Test Pieces>

An adhesive (modified epoxy-based elastic adhesive, Super X manufactured by Cemedine Co., Ltd.) was thinly and uniformly applied to each reverse surface of the hook tape and the loop tape (respectively 25 mm in width and 100 mm in length) having piles formed on the other surface, and a sheet-like vibration-damping material (25 mm in width and 100 mm in length) was adhered thereto. Each of these structures was sewn onto a composite fabric, GORE-TEX (registered trademark, manufactured by W.L. Gore & Associates Inc., 70 mm in width×150 mm in length) which is capable of easily emitting vibration produced in the surface fastener to obtain the male type and female type test pieces for peeling noise measurement.

<Measurement of Sound-Pressure Level>

Figure 8:
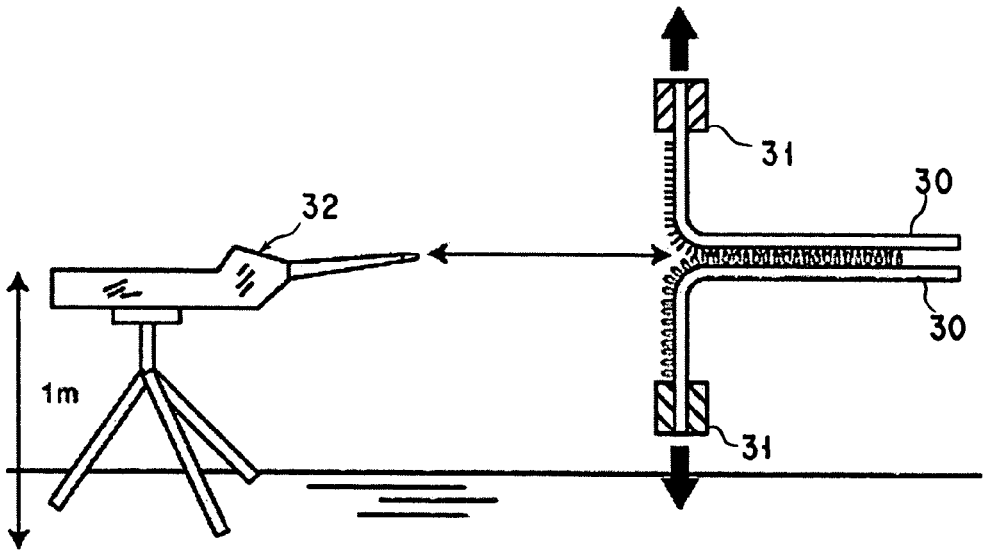
FIG. 8 is a schematic diagram for explaining the sound-pressure level measuring apparatus used in test examples.

After strongly fastening the male type and female type test pieces 30 to each other by applying pressure, each end of this press-fastened pair was pinched with a holder 31 and subjected to the T type peeling at a peel rate of 25 cm/second, as shown in FIG. 8, and the maximum value of the sound-pressure level at the time of peeling was measured at the position of measurement distance 65 mm by means of a standard noise meter 32 (manufactured by RION Co., Ltd., model ML-01A). The frequency dignity characteristic used of the noise meter was A characteristic (audition compensation) and the dynamic characteristic used was "Fast". Incidentally, when the dark noise (number of decibels of blank) was measured at the time of measurement, it was 40 dB.

TEST EXAMPLE 1

The sound-pressure level of each pair of test pieces severally prepared by the use of a crude rubber or an ether-based polyurethane rubber as a vibration-damping material and a hook tape and a loop tape both made of a monofilament having the fineness 190 T as the surface fasteners was measured. The results are shown in Table 1.

TABLE 1

| | | Monofolament Fineness (T) | Kind of Vibration-damping Material | Thickness of Vibration-damping Material (mm) | Sound-pressure Level (dB at 65 mm) | Effect |
|---|---|---|---|---|---|---|
| Reference | | 190 | None | — | 84 | — |
| Example No. | 1 | 190 | Crude rubber | 3 | 73 | ◎ |
| | 2 | 190 | Urethane rubber | 3 | 74 | ○ |

Remarks
X: No effect (decreased by 0-5 dB)
○: Effective (decreased by 6-10 dB)
◎: Considerably effective (decreased by 11 dB or more)

Figure 9:
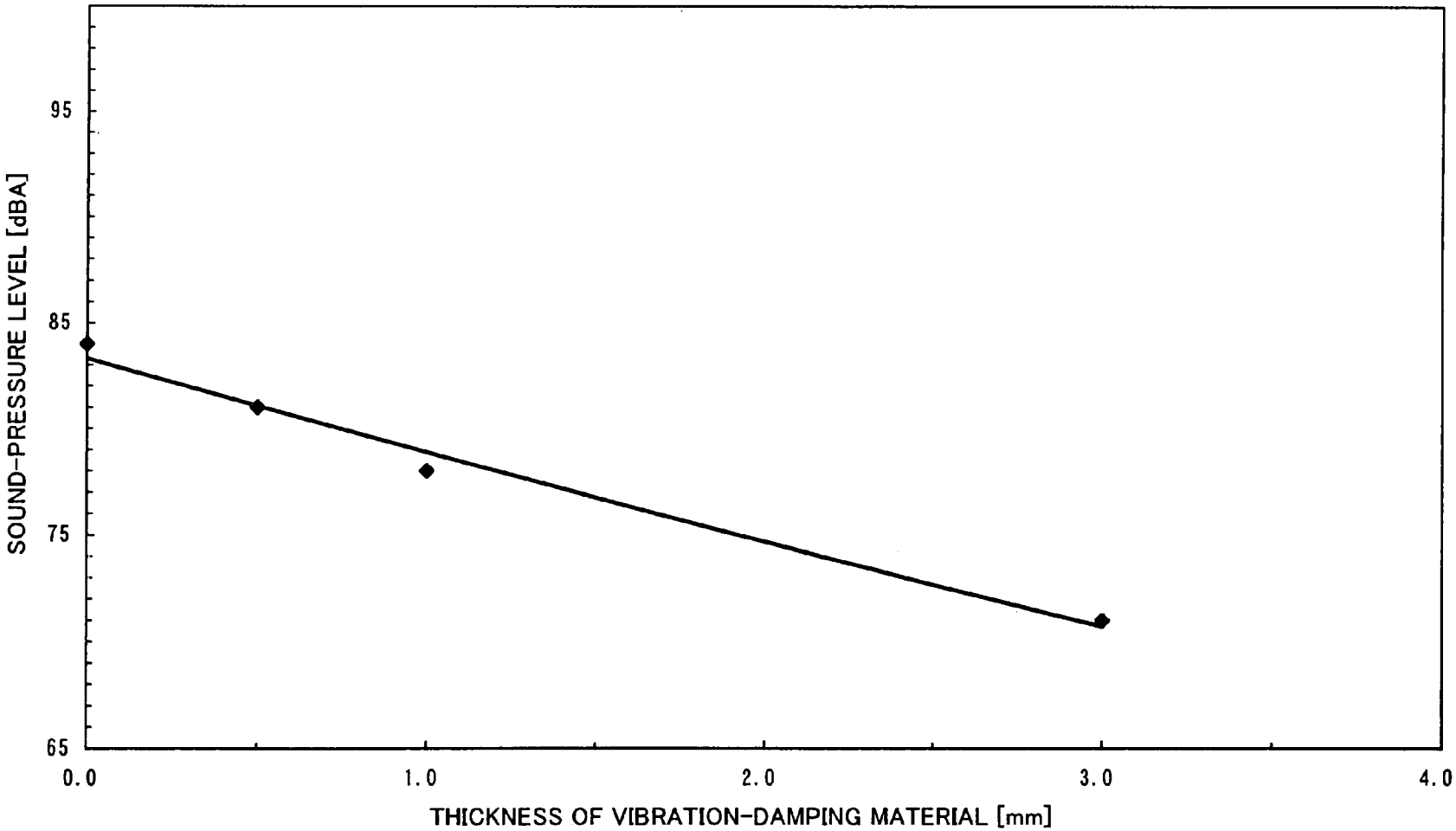
FIG. 9 is a graph showing the measurement results of the sound-pressure level from a surface fastener prepared by the use of a hook tape and a loop tape both made of a monofilament of the fineness 190 T.
Figure 10:
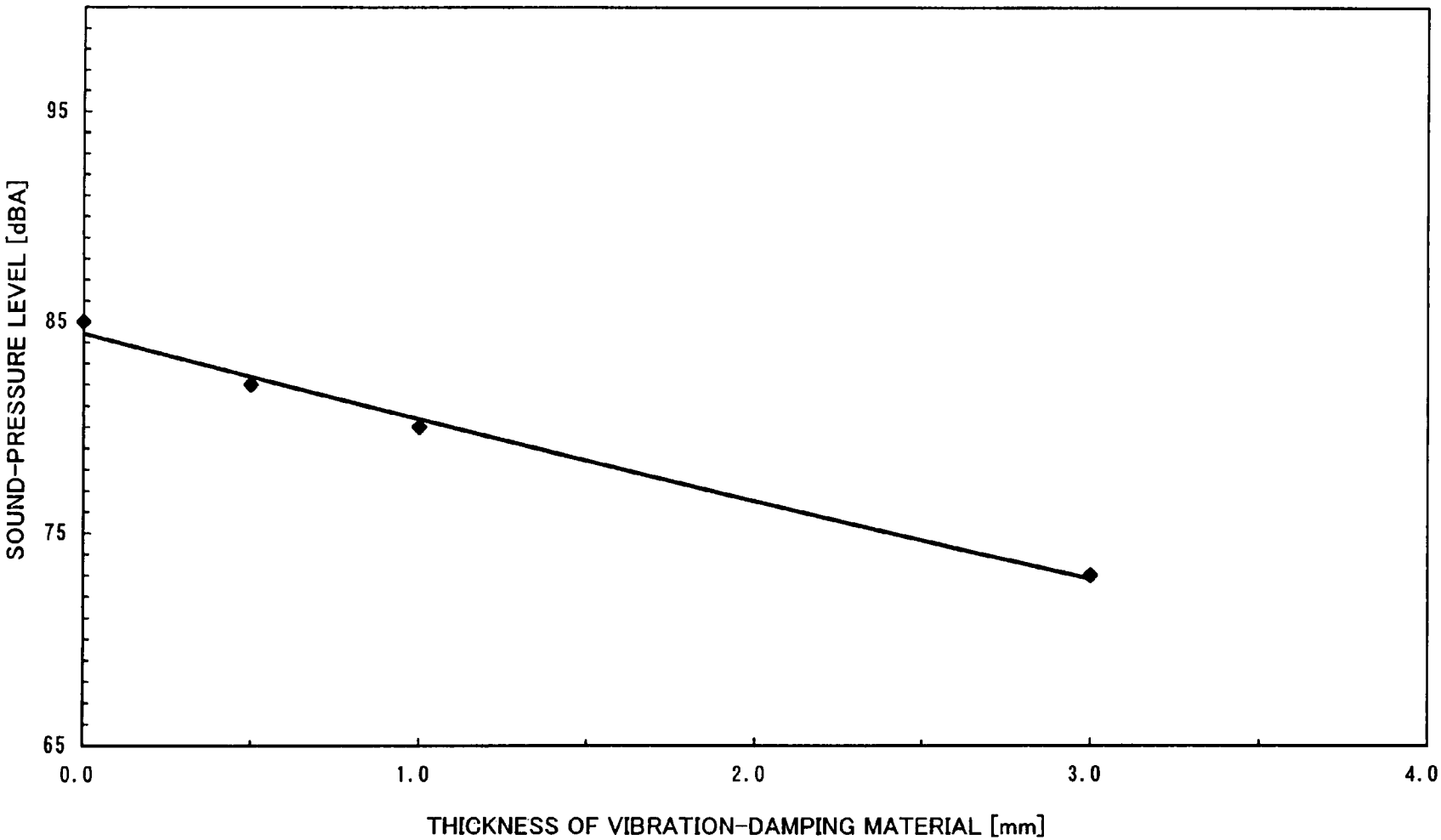
FIG. 10 is a graph showing the measurement results of the sound-pressure level from a test piece prepared by sewing onto a fabric the surface fastener prepared by the use of a hook tape and a loop tape made of a monofilament of the fineness 190 T.

Further, the sound-pressure level was measured by using a crude rubber as the vibration-damping material and changing its thickness. The results are shown in FIG. 9 and FIG. 10. Incidentally, FIG. 9 shows the measurement results of the sound-pressure level of a pair of surface fasteners prepared by the use of a hook tape and a loop tape both made of a monofilament having the fineness 190 T, and FIG. 10 shows the measurement results of the sound-pressure level of a pair of test pieces prepared by sewing them onto a fabric (GORE-TEX (registered trademark) manufactured by W.L. Gore & Associates Inc.), respectively.

TEST EXAMPLE 2

The sound-pressure level of a pair of test pieces prepared by the use of an ether-based polyurethane rubber as a vibration-damping material and a hook tape and a loop tape both made of a monofilament having the fineness 400 T as the surface fasteners was measured. The results are shown in Table 2.

TABLE 2

| | Monofolament Fineness (T) | Kind of Vibration-damping Material | Thickness of Vibration-damping Material (mm) | Sound-pressure Level (dB at 65 mm) | Effect |
|---|---|---|---|---|---|
| Reference | 400 | None | — | 94 | — |
| Example No. 3 | 400 | Urethane rubber | 3 | 81 | ◎ |

Remarks
X: No effect (decreased by 0-5 dB)
○: Effective (decreased by 6-10 dB)
◎: Considerably effective (decreased by 11 dB or more)

As being clear from the comparison of Table 1 with Table 2 mentioned above, even in the surface fastener provided with a vibration-damping material according to the present invention, that using the monofilament having smaller fineness is more excelling in the peeling noise reduction effect. Further, as being clear from FIG. 9 and FIG. 10, the more the thickness of vibration-damping material increases, the more the peeling noise reduction effect increases.

TEST EXAMPLE 3

The sound-pressure level of each pair of test pieces severally prepared by the use of an olefin-based elastomer or a vibration-damping active agent-modified polyethylene (trade name: Dipolgy, manufactured by CCI Corporation) as a vibration-damping material and hook tapes and loop tapes both made of a monofilament having the finenesses 190 T or 400 T as the surface fasteners was measured. The results are shown in Table 3 and Table 4. Incidentally, Table 3 shows the results of the sound-pressure level measured by the use of only the surface fasteners themselves before attachment to a fabric, and Table 4 shows the measurement results of the sound-pressure level of the test pieces prepared by sewing them onto a fabric (GORE-TEX), respectively.

TABLE 3

| Thickness of Vibration-damping Material (mm) | Before Attachment to Fabric | | | |
|---|---|---|---|---|
| | Olefin-based Elastomer | | Dipolgy | |
| | 190 T | 400 T | 190 T | 400 T |
| 0 | 84 | 91 | 84 | 91 |
| 0.8 | — | — | 76 | 77 |

TABLE 3-continued

| Thickness of Vibration-damping Material (mm) | Before Attachment to Fabric | | | |
|---|---|---|---|---|
| | Olefin-based Elastomer | | Dipolgy | |
| | 190 T | 400 T | 190 T | 400 T |
| 1.0 | 81 | 90 | — | — |
| 3.0 | 74 | 82 | — | — |

TABLE 4

| Thickness of Vibration-damping Material (mm) | After Sewing onto Fabric (GORE-TEX) | | | |
|---|---|---|---|---|
| | Olefin-based Elastomer | | Dipolgy | |
| | 190 T | 400 T | 190 T | 400 T |
| 0 | 85 | 90 | 85 | 90 |
| 0.8 | — | — | 81 | 86 |
| 1.0 | 84 | 91 | — | — |
| 3.0 | 82 | 89 | — | — |

When the surface fastener of the present invention is used, it is possible to open and close various bags, satchels, wallets, or the like, without necessitating to be careful in opening and closing them also in a quiet place. Particularly in the military, police, or hunting applications in which the generation of noise poses a problem, the surface fastener of the present invention may be advantageously used for holdalls, bags, belts, jackets, fabrics, gun holders, sleeping-bags, etc. Further, when it is used for underwear, combined underwear, diapers, diaper covers, baby wrappers, and coveralls for newborn babies or infants, it is possible to change clothes and diapers while sleeping, without paying attention to sound. Furthermore, as to the stationery cases etc., it is necessary to open and close them in comparatively quiet places, such as a classroom and a library, and therefore sound is an important element. The surface fastener of the present invention may be suitably used for various paper cases, pencil boxes, tying bands, systematic notebooks, etc. to be used in these places. Moreover, the surface fastener is also widely used for various articles for medical treatment. Although it is used for connection of an arm band for blood-pressure measurement, a supporter, an artificial limb, and an artificial leg, for fixation of a belt of pajamas and joining portions of pajamas, and for pillow cases, sheets, etc., those generating unpleasant sound at the time of separation is not liked. The surface fastener is also used for golf gloves and footwear such as sports shoes. The surface fastener of the present invention may also be advantageous in such a use. Furthermore, the surface fastener of the present invention may be suitably used for such applications as ordinary garments, vehicles, gap prevention of a carpet, fixation of wallpaper, the cases of various types of electronic equipment, or the like.

While certain specific embodiments and test examples have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by the foregoing description and all changes which come within the meaning and the range of equivalency of the claims are, therefore, intended to be embraced therein.

The International Application PCT/JP2004/011915, filed Aug. 19, 2004, describes the invention described hereinabove and claimed in the claims appended hereinbelow, the disclosure of which is incorporated here by reference.

What is claimed is:

1. A surface fastener material comprising a pair of fastening members to be mated with each other, each fastening member comprising a fabric and a surface fastener which is attached to said fabric, said surface fastener comprising a base part and a plurality of engaging elements raised from said base part, said fastening member further comprising a vibration-damping material layer disposed on a back surface of said base part of each fastening member, wherein said surface fastener and said fabric are unified through the medium of said vibration-damping material without leaving any gaps between said surface fastener and said vibration-damping material and between said vibration-damping material and said fabric, and said vibration-damping material layer is a rubber-like elastic material and has a loss tangent (tanδ) at −40 to 40° C. in the range of 0.05 to 2.5.

2. The surface fastener material set forth in claim 1, wherein the vibration-damping material layer is disposed on the back surface of said base part through the medium of a bonding layer.

3. The surface fastener material set forth in claim 1, wherein the thickness of said vibration-damping material layer is in the range of 0.3 to 10 mm.

4. The surface fastener material set forth in claim 1, wherein said base part is made from a woven or knitted base fabric, the plurality of engaging elements are made of a monofilament, and the fineness of said monofilament is in the range of 100 to 500 T (deciTex).

* * * * *